US007740927B2

(12) United States Patent
Yousif et al.

(10) Patent No.: US 7,740,927 B2
(45) Date of Patent: Jun. 22, 2010

(54) CONTAINER SEAL WITH INTEGRAL PROMOTIONAL TOKEN AND METHOD

(75) Inventors: Paul E. Yousif, Wheaton, IL (US); Sue A. Ross, Elmhurst, IL (US); George Antar, Morton Grove, IL (US); Bahjat Z. Yousif, Elmhurst, IL (US)

(73) Assignee: Tech-Seal Products, Inc., Schaumburg, IL (US)

( * ) Notice: Subject to any disclaimer, the term of this patent is extended or adjusted under 35 U.S.C. 154(b) by 1570 days.

(21) Appl. No.: 11/008,485

(22) Filed: Dec. 9, 2004

(65) Prior Publication Data

US 2006/0124578 A1 Jun. 15, 2006

(51) Int. Cl.
*B32B 9/00* (2006.01)
*B32B 9/06* (2006.01)

(52) U.S. Cl. ..... 428/40.1; 428/40.5; 428/486; 428/487

(58) Field of Classification Search ..... 428/40.1, 428/40.5, 486, 487
See application file for complete search history.

(56) References Cited

U.S. PATENT DOCUMENTS 3,968,823 A 7/1976 Simon
4,013,188 A 3/1977 Ray
4,280,653 A 7/1981 Elias
4,588,099 A 5/1986 Diez
4,596,338 A 6/1986 Yousif
4,666,052 A 5/1987 Ou-Yang
4,684,554 A 8/1987 Ou-Yang
4,767,654 A 8/1988 Riggsbee
4,778,698 A 10/1988 Ou-Yang
4,784,885 A 11/1988 Carespodi
4,861,644 A 8/1989 Young et al.
4,934,544 A 6/1990 Han
4,960,216 A 10/1990 Giles
5,004,111 A 4/1991 McCarthy
5,012,946 A 5/1991 McCarthy
5,019,436 A 5/1991 Schramer et al.
5,106,124 A 4/1992 Volkman et al.
5,197,618 A 3/1993 Goth (Continued)

OTHER PUBLICATIONS

U.S. Appl. No. 11/007,874, unpublished, Ross, et al.

(Continued)

*Primary Examiner*—Victor S Chang
(74) *Attorney, Agent, or Firm*—Olson & Cepuritis, Ltd.

(57) ABSTRACT

A container seal having a releasable, integral promotional token attached thereto comprises a sealing sheet bound to a promotional token by a releasable adhesive. The sealant sheet has a tacking surface and a sealing surface. The promotional token has a tacking surface and an obverse surface. At least one surface of the promotional token has promotional indicia visible thereon. The tacking surface of the promotional token is bound to the tacking surface of the sealant sheet by a releasable adhesive, so that the promotional token is peelably removable from the sealant sheet when the sealant sheet is bound to the finish of a container. In a preferred embodiment, the obverse surface of the promotional token is bound to a compressible liner by a second layer of releasable adhesive, the liner being separable from the promotional token without separating the promotional token from the sealing sheet. Preferably, the promotional indicia are in the form of a redeemable coupon, a proof-of-purchase indicator, or a game token.

12 Claims, 3 Drawing Sheets

U.S. PATENT DOCUMENTS

| | | | |
|---|---|---|---|
| 5,356,021 | A | 10/1994 | McBride et al. |
| 5,372,268 | A | 12/1994 | Han |
| 5,381,913 | A | 1/1995 | Peeters |
| 5,712,042 | A | 1/1998 | Cain |
| 5,813,563 | A | 9/1998 | Boehm et al. |
| 5,915,585 | A | 6/1999 | Ladina et al. |
| 6,032,820 | A | 3/2000 | Ladina et al. |
| 6,047,488 | A | 4/2000 | Tuszkiewicz |
| 6,082,566 | A | 7/2000 | Yousif et al. |
| 6,131,754 | A | 10/2000 | Smelko |
| 6,174,274 | B1 | 1/2001 | Hawkins et al. |
| 6,237,843 | B1 | 5/2001 | Falat et al. |
| 6,327,801 | B1 | 12/2001 | Witkowski et al. |
| 6,374,726 | B1 | 4/2002 | Melton |
| 6,670,009 | B1 | 12/2003 | Voss |
| 6,709,726 | B1 | 3/2004 | Dronzek et al. |
| 6,746,743 | B2 | 6/2004 | Knoerzer et al. |

OTHER PUBLICATIONS

U.S. Appl. No. 11/008,495, unpublished, Yousif, et al.

CONTAINER SEAL WITH INTEGRAL PROMOTIONAL TOKEN AND METHOD

FIELD OF THE INVENTION

The invention relates to improved container sealing materials and methods. More particularly, the invention relates to improved container seals having a detachable promotional token as an integral portion thereof. The invention also relates to containers sealed with the improved container seals and to a method of providing a promotional token integrated with a container seal.

BACKGROUND OF THE INVENTION

It is common practice to seal a container with a sheet material, such as paper, a polymeric film, aluminum foil, or a laminate of paper, polymeric film and/or aluminum foil. The use of such seals, in many cases, has been imposed on the packaging industry by FDA regulations, as a protection against product tampering. Such seals can provide evidence of product tampering, since they are typically destroyed by the process of removing the seal. It is also common to line the inner surface of container closures with a moderately compressible material, such as a polymeric material, pulp board, or a multilayer laminated combination thereof. When a closure containing the liner material is secured to the finish of a container, such as by applying a torque force to a threaded closure that is engaged with a threaded container finish, the resulting pressure exerted by the closure onto the liner, which is interposed between the closure and the container finish, produces a substantially liquid and/or gas-tight seal. When the closure is removed from the container, the liner remains within the closure. Re-engaging the closure with the container finish re-establishes the seal. Liner materials can utilize a pulp or paper substrate or polymeric materials, such as polyolefin foams or laminated multilayer lining materials comprising a combination of pulp or a polymeric foam along with a polymeric film, metal foil, and the like.

In a typical application, closures for containers are lined with a laminated material having a layer of pulp mounted to a layer of aluminum foil by an intermediate wax layer. Such laminated materials also frequently contain a layer of polymer, such as a polyester film, fixed by an adhesive to the foil, and a layer of sealing material fixed by an adhesive to the polyester film. The laminate is produced and shipped in roll form, which is then cut to the required shape and size, and mounted in a closure with an adhesive or by friction.

In use, the resulting lined closure is torqued onto a container, such as a bottle or jar, which has been filled with a fluid or solid product. Next, the capped container is passed through a high frequency induction heating unit. During induction heating, radio frequency energy heats the aluminum foil to a temperature in excess of about 65° C., generally about 150° C. or greater. The resulting heat melts the wax in the layer between the pulp and aluminum foil. The melted wax is absorbed by the pulp, causing the pulp to separate from the remainder of the material. The sealing material typically is selected to match the material of construction of the container, and is heat-welded (i.e., heat-sealed) to the finish of the container (i.e., the rim around the access opening of the container) utilizing the heat generated from the induction heating of the aluminum foil. When a consumer removes the closure from the container, the pulp layer remains in the closure as a liner, leaving the laminated combination of foil, polymer film, and sealing material over the access opening of the container as seal, to provide evidence of tampering and/or to prevent leakage and contamination of the container contents during storage and shipment.

In many applications there is a need for a clear, transparent seal so that the contents of the container can be viewed through the seal, particularly when an opaque container is used. There is also a need, in some applications, for a liner having a non-absorbent surface in direct contact with the contents of the container, rather than a paper layer. Such applications include, for example, when the contents of the container includes volatile materials or liquid substances that can be absorbed by the paper. The present invention provides embodiments that fulfill these needs.

Modern packaging and marketing techniques often make use of promotional materials, such as coupons, sweepstakes, games, and the like, to promote products and services. In many cases, this requires placing the coupon or other promotional material on the exterior of the container, where it is easily removed by individuals who did not purchase the product. This has led some packagers to place coupons inside the product container. When the product is a food or drug item, any coupon that contacts the contents of the container must be printed with an FDA approved ink, or must be sealed in a hermetic pouch, both of which add to the expense of the promotional materials. It would be very useful to be able to place a readily retrievable coupon or other promotional material within a container closure. Some specialized closures have been developed, which have chambers for sealing promotional materials inside the closure itself, however, such specialized closures are expensive and can be complicated to manufacture. Accordingly, there is an ongoing need for ways to conveniently include promotional materials, such as a coupon, within or on a container. There is also an ongoing need for improved container sealing materials that provide functional features such as tamper evidence, preservation of product quality, packaging integrity, and the like.

The present invention provides a promotional material (referred to hereinafter as a "promotional token") integral with a container seal, so that the promotional token can be included beneath a container closure and not in contact with the contents of the container. While container seals are a regulatory requirement for many food and drug applications, the container seals of the present invention turn this regulatory requirement into a marketing asset by integrating a useful promotional token with the container seal. The container seals of the present invention can be used with standard, conventional closures to provide a promotional token such as a coupon within or beneath the closure, without need for expensive, specialty closures having sealed chambers.

SUMMARY OF THE INVENTION

A container seal having a releasable, integrated promotional token comprises a sealant sheet releasably bound to a promotional token. The sealant sheet has a tacking surface and a sealing surface. Preferably, the sealing surface of the sealant sheet comprises a heat-sealable polymeric film. The promotional token has a tacking surface and an obverse surface. At least one surface of the promotional token has promotional indicia visible thereon. The tacking surface of the promotional token is bound to the tacking surface of the sealant sheet by a releasable adhesive, so that the promotional token is peelably removable from the sealant sheet when the sealant sheet is bound to the finish of a container. Preferably, at least one of the promotional token and the sealant sheet includes a layer of metal foil, such as aluminum foil.

In one preferred embodiment, the container seal comprises a sealant sheet and a liner with a promotional token bound therebetween. The sealant sheet has a tacking surface and a sealing surface, preferably a heat-sealable sealing surface. The promotional token has a tacking surface and an obverse surface. At least one surface of the promotional token has promotional indicia visible thereon. The tacking surface of the promotional token is bound to the tacking surface of the sealant sheet by a first layer of releasable adhesive, so that the promotional token is peelably removable from the sealant sheet when the sealant sheet is bound to the finish of a container. The liner has a closure-contacting surface and a tacking surface. The tacking surface of the liner is bound to the obverse surface of the promotional token by a second layer of releasable adhesive. Preferably, the second layer of releasable adhesive is a layer of wax and at least one of the tacking surface of the liner and the obverse surface of the promotional token is capable of absorbing a sufficient amount of liquid wax from the layer of wax to cause the liner to separate from the promotional token when the layer of wax is melted. Preferably, at least one of the sealant layer, the promotional token, and the liner includes a layer of metal foil, such as aluminum foil.

The promotional token, the sealant sheet, and the liner, when present, each independently can be a single layer of material, or a multilayer structure.

A sealed container of the present invention comprises a container having an access opening surrounded by a container finish, and having a sealant sheet bound to the finish of the container over the access opening, sealing the container. A promotional token is secured to the sealant sheet by a releasable adhesive. At least one surface of the promotional token has promotional indicia, such as a coupon, game token, proof-of-purchase indicator, and the like, visible thereon. The promotional token is peelably removable from the sealant sheet by a consumer without disruption of the seal over the access opening of the container.

In a preferred embodiment, the sealed container also comprises a closure secured to the container finish over the promotional token. Preferably, the closure includes a liner in contact with the promotional token. The liner can be adhesively secured within the closure, if desired. In some embodiments the liner is bound to the promotional token by a second layer of releasable adhesive. When a consumer removes the closure from the container, the liner remains in the closure, and the promotional token remains bound to the sealant sheet. The consumer can then peel the promotional token away from the sealant sheet, leaving the sealant sheet bound to the container finish. The consumer can then break the seal to access the contents of the container, or the consumer can replace the closure on the container leaving the tamper evident seal over the container to be removed at a later time, if desired.

A method of providing a promotional token integrated with a container seal comprises bonding the sealant sheet of a container seal of the invention to the finish and over the access opening of a container. The sealant sheet provides a seal (e.g., a tamper-evident seal) over the access opening of the container and the promotional token is removable by a consumer without breaking the seal. Optionally, the promotional token is covered by a closure secured over the finish of the container. The closure can include a liner secured within the closure between the closure and the promotional token, so that the liner remains in the closure and the promotional token remains bound to the sealant sheet of the container seal when the closure is removed from the container.

DETAILED DESCRIPTION OF PREFERRED EMBODIMENTS

Figure 1:
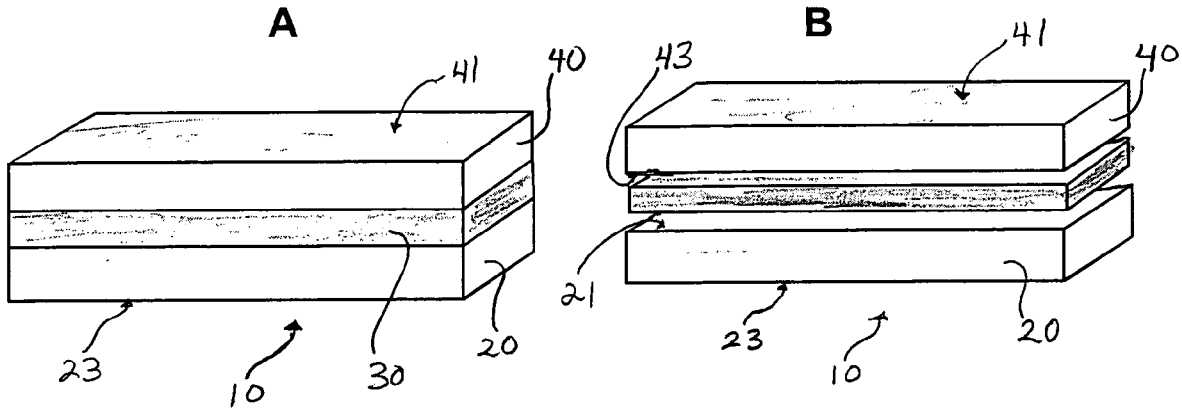
FIG. 1 is a schematic diagram of a container seal of the present invention. Panel A illustrates a promotional token 40 bound to a sealant sheet by releasable adhesive. Panel B is an exploded view of the container seal of Panel A

As used herein, the term "closure" and grammatical variations thereof, refers to a lid or cap, such as a threaded cap, a lug-type cap, a snap-cap, and the like, that is designed to be repeatedly secured to and removed from a container finish, such that when the cap or lid is secured to the container finish, a seal is formed that protects the contents of the container from contamination and leakage.

The terms "lining material" and "liner" refer to a sheet material that is compressible and preferably semirigid, and is suitable for use within a closure to provide a resealable seal between the closure and a container finish. The term "liner" also refers to a section of lining material that has been cut to fit snugly within a closure against the upper inside surface thereof.

The term "seal" refers to a film or multilayer laminate material that is adhesively secured or heat-sealed over the finish of a container to provide an air and/or fluid tight seal. To access the contents of the container, the seal must be broken. A seal can provide evidence of product tampering, for example, when removal of the seal leaves a residue on the finish of the container. A container is typically is fitted with a closure over a container seal. The closure protects the integrity of the seal during shipping and storage. Closures typically include a liner so that after the container seal is removed, the closure can be put back on the container to protect the contents that may remain in the container.

The term "promotional token" as used herein and in the appended claims, refers to a flexible sheet material suitable for use in a container sealing product, which includes information (i.e., promotional indicia) promoting a product, a service, a game (e.g., a contest or sweepstakes), a company, an organization, a political or social cause, and the like. The promotional indicia are visible on one or both surfaces of the sheet material.

The term "wax", as used herein and in the appended claims is not limited to natural waxes and parafins, but also encompasses materials commonly referred to as waxes in the packaging and converting industries, such as microcrystalline wax, polyethylene wax, polyisobutylene resins, and so-called synthetic waxes (e.g., amide waxes), as well as mixtures thereof.

A container seal having a releasable, integral promotional token comprises a sealant sheet bound to a promotional token. The sealant sheet has a tacking surface and a sealing surface. The promotional token has a tacking surface and an obverse surface. At least one surface of the promotional token has promotional indicia visible thereon. The tacking surface of the promotional token is bound to the tacking surface of the sealant sheet by a releasable adhesive, so that the promotional token is peelably removable from the sealant sheet when the sealant sheet is bound to the finish of a container.

In one embodiment, the container seal comprises a sealant sheet and a liner with a promotional token bound therebetween. The sealant sheet has a tacking surface and a sealing surface, preferably a heat-sealable sealing surface. The promotional token has a tacking surface and an obverse surface. At least one surface of the promotional token has promotional indicia visible thereon. The tacking surface of the promotional token is bound to the tacking surface of the sealant sheet by a first layer of releasable adhesive, so that the promotional token is peelably removable from the sealant sheet when the sealant sheet is bound to the finish of a container. The liner has a closure-contacting surface and a tacking surface. The tacking surface of the liner is bound to the obverse surface of the promotional token by a second layer of releasable adhesive.

The sealant sheet, the promotional token and the liner can each comprise one or more layers of material, such as cellulose pulp, paper, a synthetic fabric, a polymer film, a polymer foam, a metal foil, and the like, or any combination thereof, the layers being bound together to form a laminate material. Preferably, at least one of the sealant sheet, the promotional token, and the liner includes a layer of metal foil, such as aluminum foil. In heat-sealable embodiments, the sealing surface of the sealant sheet comprises a heat-sealable polymer film for heat-bonding to a container finish.

A sealed container of the present invention comprises a container having an access opening surrounded by a container finish. The container includes a seal over its access opening. The seal comprises a sealant sheet having a sealing surface and a tacking surface. The sealing surface is directly bound to the finish of the container, covering the access opening, and a promotional token is bound to the tacking surface of the sealant sheet by a releasable adhesive. At least one surface of the promotional token has promotional indicia visible thereon. The promotional token is peelably removable from the sealant sheet by a consumer without disruption of the seal covering the access opening of the container.

In one embodiment, the sealed container also comprises a closure secured to the container finish over the promotional token. Preferably, the closure includes a liner in contact with the promotional token. The liner preferably is adhesively secured within the closure. In some embodiments the liner is bound to the upper obverse surface of the promotional token by a second layer of releasable adhesive. The bonding strength of the second layer of releasable adhesive is weaker than the bonding strength of the first layer of adhesive, which in turn is weaker than the bond between the sealant sheet and the container finish. When a consumer removes the closure from the container, the liner, which is bound to the closure, shears away from the promotional token, breaking the adhesive bond between the liner and the promotional token. The promotional token remains intact and bound to the sealant sheet. The consumer can then peel the promotional token away from the sealant sheet, leaving a seal (e.g., a tamper-evident seal) bound to the container finish. The consumer can then break the seal to access the contents of the container, or the consumer can replace the closure on the container leaving the tamper evident seal over the container to be removed at a later time, if desired.

A method of providing a promotional token integrated with a container seal comprises bonding the sealing surface of a container seal of the invention to the finish and over the access opening of a container. The container seal provides a seal over the access opening and the promotional token is removable by a consumer without breaking the seal. Optionally, the promotional token is covered by a closure secured over the finish of the container. In some embodiments, the closure can include a liner secured within the closure between the closure and the promotional token When a consumer removes the closure from the container, the liner remains in the closure and the promotional token remains releasably bound to the sealant sheet of the container seal.

Referring now to the Drawings, wherein similar reference-numbers refer to correspondingly similar components, FIG. 1 schematically illustrates container seal 10 of the present invention. Panel A shows promotional token 40 bound to sealant sheet 20 by a layer of releasable adhesive 30. Panel B, in exploded view, illustrates that tacking surface 43 of promotional token 40 is bound to tacking surface 21 of sealant sheet 20 by releasable adhesive 30. Obverse surface 41 of promotional token 40 is oriented toward the top of the drawing, whereas sealing surface 23 of sealant sheet 20 is oriented to ward the bottom of the drawing.

Figure 2:
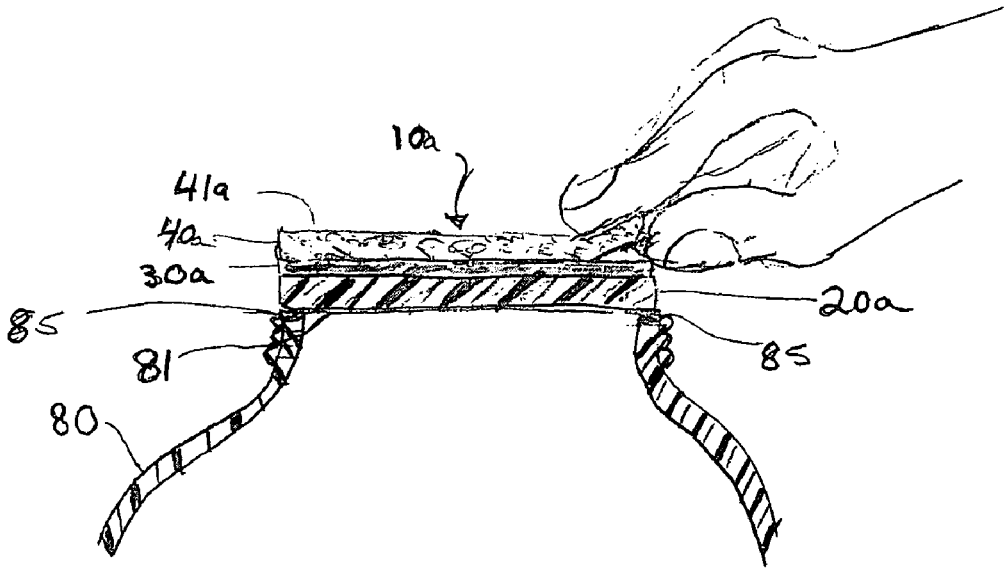
FIG. 2 is a cross-sectional view of a container seal of the invention sealed over the finish of a container and illustrating that the promotional token is peelably removable from sealant sheet.

FIG. 2 provides a cross-sectional view of container seal 10*a* sealed to finish 81 of container 80. Sealant sheet 20*a* is bound to surface 85 of container finish 81. Promotional token 40*a* is bound to sealant sheet 20*a* by releasable adhesive 30*a*. In this embodiment, sealant sheet 20*a* is a single layer of heat-sealable polymer heat-fused to container finish 81. In other embodiments, sealant sheet 20*a* can be a multilayer laminated sheet material. Promotional token 40*a* is a single layer of paper bound to sealant sheet 20*a* by a layer of releasable, pressure-sensitive adhesive 30*a*. It is understood that in other embodiments promotional token 40*a* can be a multilayer laminated sheet material. The figure illustrates that promotional token 40*a* is peelably removable from sealant sheet 20*a* by grasping an edge of promotional token 40*a* and pulling it off of sealant sheet 20*a*. Sealant sheet 20*a* remains bound to surface 85 of container finish 81 when promotional token 40*a* is removed.

Figure 3:
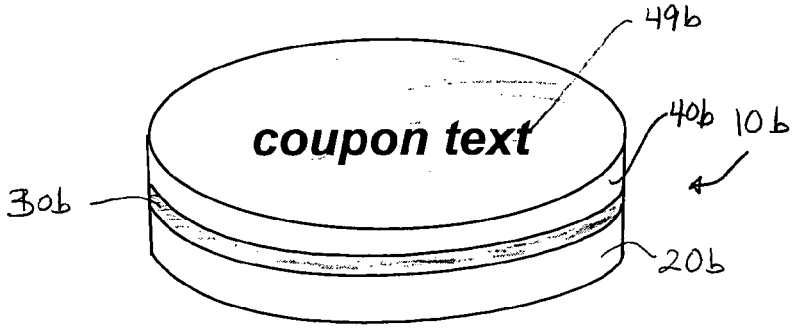
FIG. 3 illustrates a container seal of the invention, having a coupon visible on a surface of the promotional token.

FIG. 3 illustrates container seal 10*b* in perspective view, showing coupon 49*b* visible on obverse surface 41*b* of promotional token 40*b*. Coupon 49*b* can be printed directly on obverse surface 41*b* or can be printed below surface 41*b* if obverse surface 41*b* is transparent.

Figure 4:
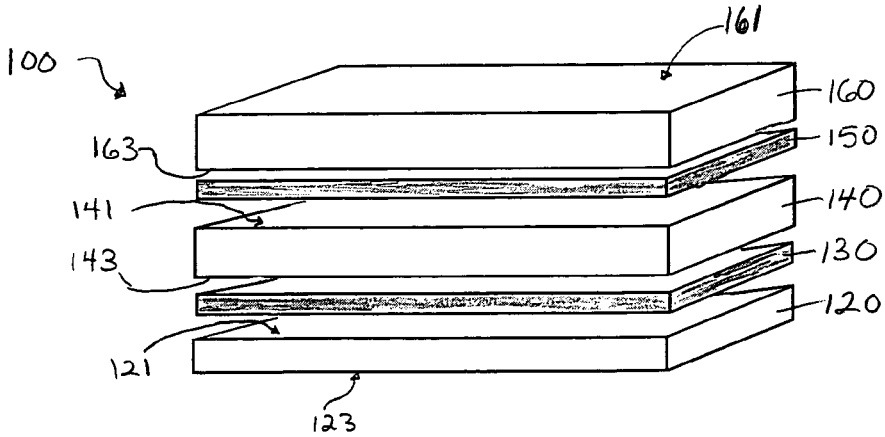
FIG. 4 illustrates an embodiment of the container seal of the present invention, including a liner bound to the obverse face of the promotional token.

FIG. 4 illustrates, in exploded view, another embodiment of a container seal of the present invention, which includes a liner. Container seal 100 comprises sealant sheet 120 bound to promotional token 140 by a first layer of releasable adhesive 130, and liner 160 bound to promotional token 140 by a second layer of releasable adhesive 150. Sealant sheet 120 includes sealing surface 123 and tacking surface 121. Tacking surface 121 of sealant sheet 120 is bound to tacking surface 143 of promotional token 140 by first layer of releasable adhesive 130. Obverse surface 141 of promotional token 140 is bound to tacking surface 163 of liner 160 by second layer of releasable adhesive 150. Liner 160 comprises a compressible material such as cellulose pulp or a polymeric foam.

In one form of container seal 100, second layer of releasable adhesive 150 is selected to have a lower adhesive strength than first layer of releasable adhesive, so that liner 160 is removable from promotional token 140 without disrupting the bond between promotional token 140 and sealant sheet 120. The relative strength of adhesion for the first and second layers of releasable adhesive can be controlled by the thickness of the two adhesive layers (a thinner layer having a lower adhesive strength, in general), by choosing adhesives having different chemical bonding strengths, by making second layer 150 an intermittent layer of adhesive, such as an array of adhesive stripes or an array of adhesive dots, or by other methods that are well known to those of ordinary skill in the packaging and adhesive arts.

Figure 5:
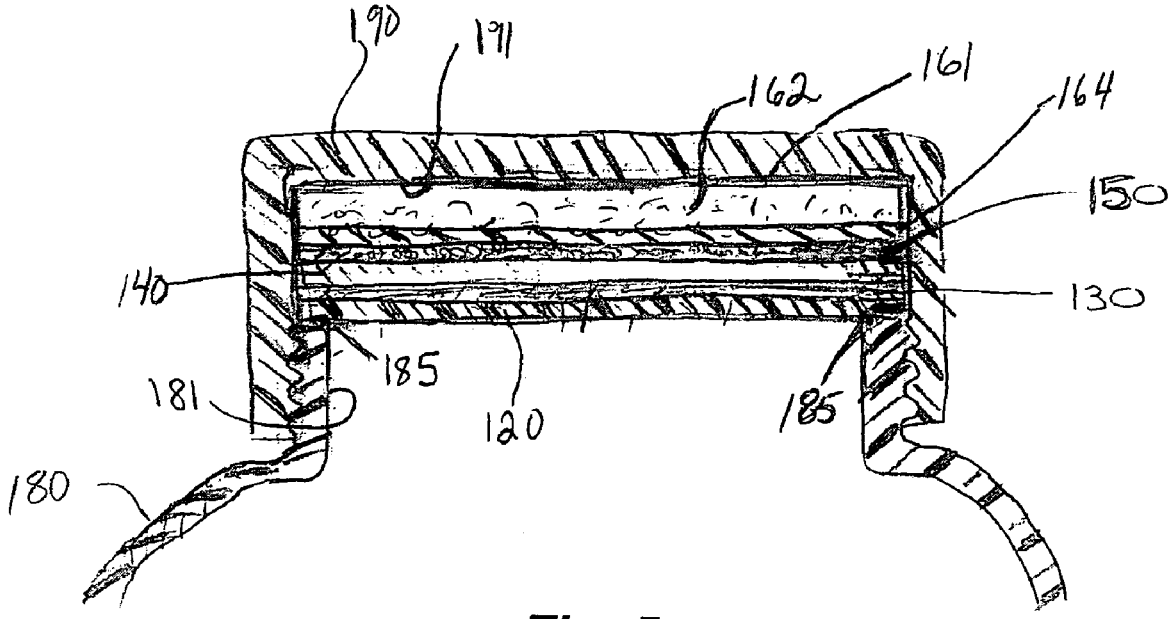
FIG. 5 illustrates, in cross-section, a container seal of the invention bound to the finish of a container. A closure covers the promotional token and includes a liner between the promotional token and the inside top of the closure.

In use (see FIG. 5), container seal 100 is placed in closure 190, with closure-contacting surface 161 of liner 160 bound to the inside surface 191 of closure 190 by a bead of adhesive 170. Closure 190 is affixed over finish 181 of container 180 so that sealing surface 123 of sealant sheet 120 is pressed against surface 185 of container finish 181. Surface 185 of container finish 181 can include a coating of adhesive to bond sealing surface 123 to surface 185. Alternatively, sealing surface 123 can comprise a heat-sealable film and can be bound to surface 185 by application of heat to the heat-sealable film. When a heat-sealable film is utilized as sealing surface 123, at least one of liner 160, promotional token 140, and sealant sheet 120 preferably comprises a metal foil, such as aluminum foil. The closed container can then be passed through an induction heating device, which heats the foil using radio frequency energy. The heat from the foil causes the heat-sealable film of sealing layer 123 to bond to surface 185 of finish 181, forming a tamper-evident seal over the mouth of container 180. When a consumer removes closure 190 from container 180, liner 160 stays in closure 190 and breaks away from promotional token 140 as closure 190 is removed. Sealant sheet 120 stays bound over the access opening of container 180, and promotional token 140 remains affixed over sealant sheet 120. Promotional token 140 can be peeled away from sealant sheet 120 without breaking the bond between sealing surface 123 and the container finish, as shown in FIG. 2 for container seal embodiment 10*a*.

In a heat-releasable form of container seal 100, second layer of releasable adhesive 150 is a layer of wax, and at least one of tacking surface 163 and obverse surface 141 comprises a wax-absorbent material, such as paper or a synthetic fabric. The wax-absorbent material is capable of absorbing a sufficient amount of the wax from layer 150 to cause liner 160 to release and separate from promotional token 140 when the wax is melted. In this form of container seal 100, at least one of liner 160, promotional token 140 and sealant sheet 120 preferably comprises a layer of metal foil (e.g., aluminum foil). Sealing surface 123 of sealant sheet 120 preferably comprises a heat-sealable polymeric film.

The heat-releasable form of container seal 100 is utilized by heating sealant sheet 120 to a temperature sufficient to bond the heat-sealable polymer film at its sealing surface 123 to the finish 181 of the container 180. The heat supplied to sealant sheet 120 also melts wax in releasable adhesive layer 150. The melted wax is absorbed by a wax absorbent tacking surface in contact with layer 150, so that liner 160 releases from promotional token 140.

Figure 6:
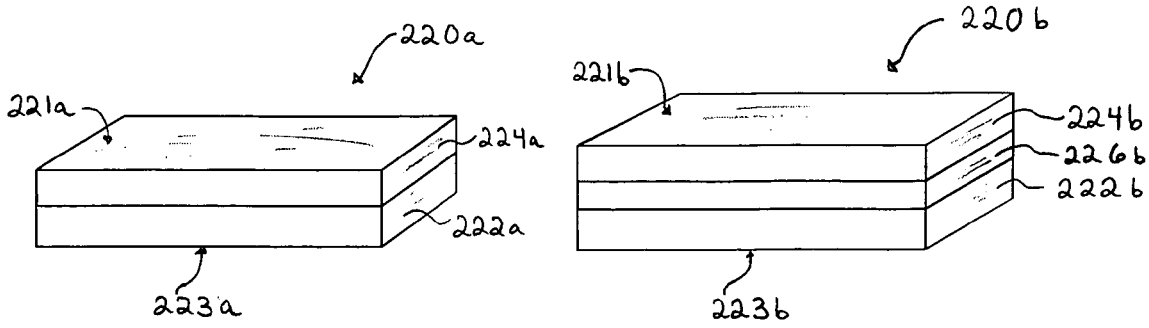
FIG. 6 illustrates two alternative forms of sealant sheet useful in the container seals of the invention.

Two embodiments of a sealant sheet (220*a* and 220*b*) are shown in FIG. 6. Sealant sheet 220*a* is a two-layer sealant sheet having a tacking surface 221*a* and a sealing surface 223*a*. Sealant sheet 220*a* comprises a sealing layer 222*a* and facing layer 224*a* bonded thereto. Facing layer 224*a* can comprise a polymeric foam, a polymer film (e.g., a barrier film), a metal foil, or a layer of wax-absorbent material, such as paper or a synthetic fabric. Sealing layer 222*a* can comprise a polymeric foam, a polymer film (e.g., a barrier film or heat-sealable film), a metal foil, or a layer of paper or synthetic fabric. Sealant sheet 220*b* is a three-layer structure having a tacking surface 221*b* and a sealing surface 223*b*. Sealant sheet 220*b* comprises sealing layer 222*b* and facing layer 224*b* with a core layer 226*b* bound therebetween. Facing layer 224*b* and core layer 226*b* each independently can comprise any of the materials as described above for facing layer 224*a*. Sealing layer 222*b* can comprise any of the materials described above for sealing layer 222*a*. In one form of sealant sheet 220*a*, facing layer 224*a* is a polymeric barrier film and sealing layer 222*a* is a heat-sealable polymer film.

Figure 7:
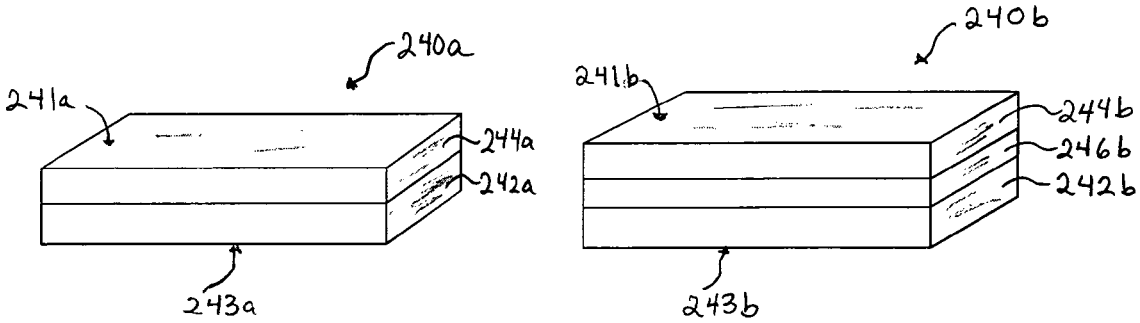
FIG. 7 illustrates two alternative forms of promotional token useful in the container seals of the invention.

Two embodiments of a promotional token (240*a* and 240*b*) are shown in FIG. 7. Promotional token 240*a* is a two-layer promotional token having an obverse surface 241*a* and a tacking surface 243*a*. Promotional token 240*a* comprises a first facing layer 242*a* and second facing layer 244*a* bonded thereto. Facing layers 242*a* and 244*a* each independently can comprise a polymeric foam, a polymer film, a metal foil, or a layer of wax-absorbent material, such as paper or a synthetic fabric. At least one of obverse surface 241*a* and tacking surface 243*a* of promotional token 240*a* includes promotional indicia, such as a redeemable coupon, a game token, a proof-of-purchase indicator, and the like, visible thereon. Promotional token 240*b* is a three-layer structure having an obverse surface 241*b* and a tacking surface 243*b*. Promotional token 240*b* comprises first and second facing layers 242*b* and 244*b*, respectively, with a core layer 246*b* bound therebetween. First and second facing layers 242*b* and 244*b* and core layer 246*b* each independently can comprise any of the materials as described above for facing layers 242*a* and 244*a*. At least one of obverse surface 241*b* and tacking surface 243*b* of promotional token 240*b* includes promotional indicia visible thereon.

Figure 8:
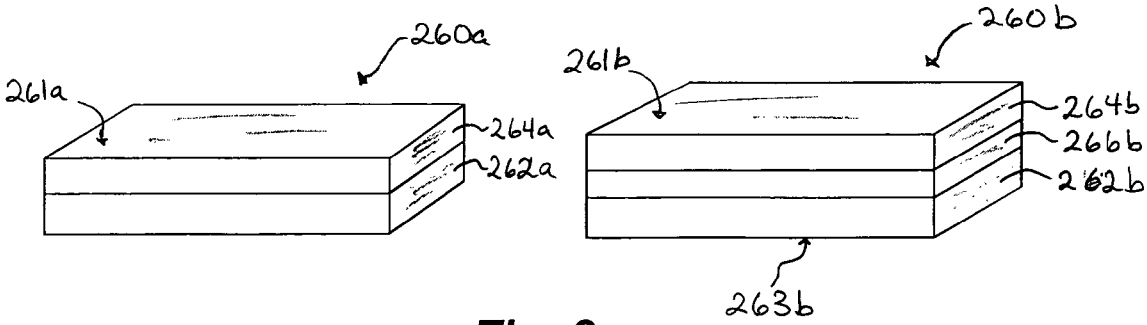
FIG. 8 illustrates two alternative forms of liner useful in the container seals of the invention.

Two embodiments of a liner (260*a* and 260*b*) are shown in FIG. 8. Liner 260*a* is a two-layer liner having a closure-contacting surface 261*a* and a tacking surface 263*a*. Liner 260*a* comprises compressible substrate 264*a* and facing layer 262*a* bonded thereto. Substrate 264*a* can comprise any compressible material suitable for use in closure liners, such as cellulose pulp, polymeric foam, and the like. Facing layer 262*a* can be a polymer film, a metal foil, or a layer of liquid-wax absorbent material such as paper or a synthetic fabric. Liner 260*b* is a three-layer structure having a closure-contacting surface 261*b* and a tacking surface 263*b*. Liner 260*b* comprises compressible substrate 264*b* and facing layer 262*b*, with a core layer 266*b* bound therebetween. Substrate 264*b* can comprise any compressible material suitable for use in closure liners, as described above for substrate 264*a*. Facing layer 262*b* and core layer 266*b* each independently can be a polymer film, a metal foil, or a wax-absorbent material as described above for facing layer 262*a*. In one form of liner 260*b*, substrate 264*b* is a layer of cellulose pulp or polymeric foam, core layer 266*b* is a layer of metal foil, and facing layer 262*b* is a polymeric film.

The container seals of the present invention can include any combination of single-layer or multilayer sealant sheet, promotional token, and liner, as described above. Multilayer sealant sheets, promotional tokens, and liners preferably are two-layer, three-layer, four-layer or five-layer structures. Multilayer structures generally comprise sheets of cellulose pulp, paper, synthetic fabric, polymer film, polymer foam, metal foil, and the like, or any combination thereof, adhesively bonded together or thermally fused together to form a unitary structure, as is well known in the materials converting and laminating arts.

In one illustrative use, a container seal of the invention can be die-cut to an appropriate size and shape and conveniently placed within a container closure (e.g., a cap) as a single unit. The container seal is sized to fit securely within the closure and is placed in the closure with its sealing surface facing outward. When the container seal includes a liner portion, the liner preferably is bound to the inside top of the closure by an adhesive, such as a hot-melt adhesive. The closure is then secured to the finish of a container (e.g., a bottle or a jar), for example, by torquing a threaded closure onto a threaded finish of a container after the container has been filled with a product. If the container seal is to be sealed to the finish by an adhesive, the adhesive is applied to the container finish before the sealing surface is placed into contact with the finish.

If the sealing surface comprises a heat-sealable polymeric film, no adhesive is required on the finish, rather, heat is applied to the container seal to bond the sealing surface to the container finish. Heat can be applied to the container seal inductively, if at least one of the liner, promotional token or sealant sheet includes a metal foil layer, or if the closure is metal. In the inductive heating process, the container is passed through an induction-sealing device in which radio frequency (rf) energy inductively heats the metal foil (or metal closure), preferably to a temperature in the range of about 65 to about 150° C. For a container seal having a heat-releasable liner, the heat from metal foil also liquefies the layer of wax that tacks the liner to the promotional token. The wax is then absorbed by a wax-absorbent material in contact with the wax layer, causing the liner to release and separate from promotional token. The wax layer that binds the liner to the promotional token preferably is selected to have a melting point in the range of about 65 to about 150° C.

Upon removal of the closure by a consumer, the liner remains in the closure, while the sealant sheet, with its attached promotional token, remains bound to the finish of the container as a protective seal. The promotional token is peelably removable by a consumer when the closure is removed.

Liner components preferably include compressible materials, such as a cellulose pulp material, a polymeric foam, or a polymeric film. Preferred polymeric foams include a polyolefin foam, a substituted polyolefin foam, or a polyurethane foam. Suitable polyolefin foams include foams of polyethylene, polypropylene, ethylene propylene copolymers, and blends thereof. Non-limiting examples of suitable substituted polyolefins include polystyrene foam, polyvinyl chloride foam, and foam rubber. Preferably, the polyolefin foam is a polyethylene foam, more preferably a low-density polyethylene foam.

The liner, when present, preferably has a thickness in the range of about 15 to about 60 mils (thousandths of an inch), and more preferably about 20 to about 40 mils.

Cellulose pulp-based substrates, which are commonly used in closure liners, can be laminated to other materials such as a metal foil, a polymer film, or to a foil/film laminate using conventional lamination techniques that are well known in the art.

Polymeric foams useful in the container seals of the present invention can be secured to other layers of material, such as a metal foil, paper, synthetic fabric, or polymer film, by lamination or by extruding the foam directly onto a web of the other material. Methods of extruding polymeric foams are well known in the polymer art. For example, methods of producing polymeric foams are described in A. Brent Strong, *Plastics Materials and Processing,* 2nd Ed., Prentice Hall Inc., Upper Saddle River, N.J., Chapter 17, pp. 589-614 (2000), the disclosure of which is incorporated herein by reference. The polymeric foams can be manufactured using any known foaming process, e.g. by mechanical foaming, chemical foaming, physical foaming, and the like. Preferably, the polymeric foam is formed by chemical foaming with a blowing agent. Blowing agents are well known in the polymer arts.

Suitable blowing agents include the following chemicals designated by the U.S. Environmental Protection Agency as suitable replacements for chlorofluorocarbons (CFC's) and hydrochlorofluorocarbons (HCFCs) for use as blowing agents in polyolefin foams:

Methylene chloride (dichloromethane);
1,1,1,2-tetrafluoroethane (HFC-134a);
1,1,-difluoroethane (HFC-152a);
1,1,1-trifluoro 2,2-dichloroethane (HCFC-123);
1,1,1-trifluoroethane (HFC-143a);
1,1,1,3,3-pentafluoropropane (HFC-245fa);
saturated light hydrocarbons ($C_3$-$C_6$ hydrocarbons);
water; and
carbon dioxide.

Other suitable blowing agents include chemical blowing agents such as carbonate and azo type compounds. Such compounds include, without being limited thereto, ammonium carbonate, ammonium bicarbonate, potassium bicarbonate, sodium bicarbonate, diazoaminobenzene, diazoaminotoluene, azodicarbonamide, diazoisobutyronitrile, and the like.

Metal foils useful in the container seals of the present invention can comprise any metal that is suitable for use in a closure liner or container seal. Choice of a particular metal will depend on the nature of the material to be included in the container to be sealed by the container seal of the invention, although aluminum foil is the most common conventional metal foil used for induction dealing purposes, and is particularly preferred. Preferably, the metal foil is aluminum foil having a thickness in the range of about 1 mil to about 2 mils.

Materials suitable for use as a polymer film in the container seals of the invention include, for example, polyolefins such as polyethylene or polypropylene, polyesters such as PET, functionalized polyolefins such as ethylene vinyl alcohol (EVOH) or ethylene vinyl acetate (EVA) polymers, halogenated polyolefins such as polyvinyl chloride (PVC) or polyvinylidene chloride (PVdC), acrylonitrile methacrylate copolymer films (e.g., BAREX® film, BP Chemicals, Inc., Cleveland, Ohio), and the like. The polymer film can be a single layer of polymer, or a multilayer structure comprising two or more layers of polymer bound together. A particularly preferred polymer film is PET film. Preferably, the polymer film has a thickness in the range of about 0.5 to about 2 mils.

Adhesives suitable for permanently securing various layers of the container seals of the invention to one another include epoxy adhesives, solvent-based cements containing synthetic rubber or a phenolic resin, acrylic adhesives, urethane adhesives, or any other suitable adhesive, or a tie-layer. Tie-layers are often used to provide adhesion between a nonpolar polymer, such as polyethylene, and a polar polymer such as ethylene vinyl alcohol (EVOH). Typically, tie-layers are functionalized polyolefins such as ethylene acrylic acid copolymers, ethylene vinyl acetate copolymers (EVA), and the like, as is well known in the art.

One preferred form of adhesive is a solventless adhesive system, such as MOR-FREE® 403A/C117, available from Rohm & Haas Corp., Springhouse, Pa.). Another preferred adhesive is the two part adhesive available under the trade name ADCOTE® 503 adhesive, from Rohm & Haas Corp, which is epoxy resin used in combination with a curing agent such as Coreactant F, also available from Rohm & Haas Corp. Other preferred adhesives include solventless adhesive systems, which are also available from Rohm & Haas, for example. Adhesives useful in a variety of applications are discussed in detail in Arthur H. Landrock, *Adhesives Technology Handbook*, Noyes Publications, Park Ridge, N.J., (1985), incorporated herein by reference (hereinafter "Landrock").

Releasable adhesives useful for tacking the promotional token to the sealant sheet and the liner to the promotional token include weakly bonding adhesives, such as pressure-sensitive adhesives, wax and wax-based adhesives, and the like. Intermittent layers of permanent adhesives can also be utilized. Intermittent layers include arrays of adhesive stripes or dots, the stripes or dots being spaced from one another so that the promotional token can be peeled from the sealant sheet without tearing of either material.

Pressure sensitive adhesives are discussed at pages 174-175 of Landrock. Such pressure sensitive adhesives include natural rubber adhesives, natural rubber/styrene-butadiene rubber adhesives, polyisobutylene adhesives, butyl rubber adhesives, as well as mixtures of natural rubber with tackifying resins such as rosins, petroleum, and terpenes. Other pressure sensitive adhesives include ethylene/vinyl acetate copolymers tackified with resins or softeners, vinyl ether polymers, silicone rubber and silicone resin adhesives, and the like.

When a pressure sensitive adhesive is used, one surface in contact with the adhesive can include a release coating, so that the adhesive will have a greater affinity for one surface that the other surface with which it is in contact. For example, the tacking surface of the promotional token can include a release coating so that pressure sensitive adhesive will remain on the tacking surface of the sealant sheet when the promotional token is peeled away from the sealant sheet. Release coatings include acrylic acid esters of long-chain fatty alcohols, polyurethanes incorporating long aliphatic chains, cellulose esters, polytetrafluoroethylene, and the like.

Preferably, the promotional token is bound to the sealant sheet by a pressure sensitive adhesive and the tacking surface of the promotional token includes a release coating. When a liner is included with the container seal, preferably the promotional token is bound to the sealant sheet by a pressure sensitive adhesive, the tacking surface of the promotional token includes a release coating, the tacking surface of the liner is bound to the obverse surface of the promotional token by a layer of wax, and at least one of the tacking surface of the liner and the obverse surface of the promotional token comprises a wax-absorbent material.

If an adhesive is utilized, a polymeric foam and/or a polymeric film can be surface-treated to improve adhesion. Suitable surface treatments include, without being limited to, chromic acid etching, corona treatment, oxidizing flame treatment, gas plasma treatment, and the like.

The wax-absorbent materials useful in the present invention can be a paper, cellulose pulp (e.g., pulp board), or an absorbent synthetic fabric, such as a nonwoven fabric, an absorbent polymeric foam, a porous polymeric film, and the like. The wax-absorbent material can be can be a single layer of absorbent material, or a multilayer structure comprising two or more layers of absorbent material bound together (e.g, by an adhesive). In any event, the wax-absorbent material is selected to be capable of absorbing a sufficient quantity of the wax to cause the liner to release from the promotional token.

The thickness of a wax-absorbent material is selected so that the material will absorb a sufficient amount of a wax layer to allow the liner to release from the promotional token when the wax is melted. Preferably, the wax absorbent material has a thickness in the range of about 1 mil to about 12 mils, more preferably about 2 mils to about 10 mils, and most preferably about 2.5 mils to about 6 mils.

Paper, cellulose pulp, and synthetic fabric materials are useful components of the container seals of the invention even when a wax layer is not utilized. In particular, paper and synthetic fabric materials are preferred materials for use in the promotional token. For example, the promotional token can be a single layer of paper or a synthetic fabric. Alternatively, the promotional token can be a multilayer laminate having one or more layers of paper or synthetic fabric as a facing layer. Paper and synthetic fabrics are also particularly useful as a facing for the liner and/or the sealant sheet.

Suitable paper and cellulose pulp materials for use in the container seals of the invention include bleached or unbleached Kraft paper, single-layer or multilayer glassine paper, bleached or unbleached cellulose pulp, clay-coated papers, or any other paper or cellulose sheet material commonly used in container seals or liners in the packaging industry.

Synthetic fabrics that are useful in the container seals of the invention include nonwoven polyolefin fabrics and nonwoven polyester fabrics. Suitable nonwoven polyolefin fabrics include nonwoven polyethylene materials, such as a microporous polyethylene film or spunbonded high density polyethylene, as well as nonwoven polypropylene, nonwoven ethylene-propylene copolymer, and nonwoven blends thereof. Suitable nonwoven polyester fabrics include nonwoven polyethylene terephthalate fabrics and spunlaced DACRON™ polyester-based fabrics available from E.I. DuPont de Nemours & Co., Inc. of Wilmington, Del. (Dupont), under the trade name SONTARA®. Preferably, the synthetic fabric is an absorbent polyethylene non-woven fabric such as TYVEK® non-woven fabric, available from DuPont, or a microporous polyethylene film sold under the trade name TESLIN® by PPG Industries, Inc., Pittsburgh, Pa.

A wax layer for tacking a liner to a promotional token preferably comprise paraffin, a microcrystalline wax, a polyethylene wax, a polyisobutylene resin, a butyl rubber resin, a synthetic wax such as an amide wax (e.g., a stearamide, an oleamide, or erucamide), or a mixture thereof. More preferably the wax layer comprises paraffin, a microcrystalline wax, or a combination thereof. Most preferably the wax layer comprises a microcrystalline wax. A wax layer can be deposited utilizing an emulsion of a wax material, as described above, suspended in an aqueous medium. A wax layer, when present preferably has a melting point in the range of about 65 to about 150° C. Preferably, a wax layer has a thickness of about 0.2 to about 2 mils, more preferably about 0.5 to about 0.75 mils.

A barrier film, when present, preferably comprises a polymeric material having oxygen barrier, moisture barrier, solvent barrier, or toughness (i.e, puncture resistance) properties, as desired, based on the type of contents that will be included within a container sealed by the container seal of the invention. The barrier film can be a single layer of polymer, or a multilayer structure comprising two or more layers of polymer either directly bound to one another or adhesively secured to each other. Non-limiting examples of materials that can be used as a moisture barrier film include vinyl chloride/vinylidene chloride copolymer (i.e., PVC-PVdC) films marketed by Dow Chemical Company under the trademark SARAN®, polyethylene, oriented polypropylene (OPP), OPP/polyvinyl chloride (PVC) laminates, and OPP/PVC-PVdC laminates. Non-limiting examples of materials that can be used as an oxygen barrier film include PVC-PVdC, PET, PVC-PVdC/PET laminates, acrylonitrile methacrylate copolymer films, PVdC, and OPP/PVC-PVdC laminates. Non-limiting examples of solvent resistant films include PET and polyethylene. Non-limiting examples of puncture resistant films include PET and PVC. Preferred barrier films are PET, PVdC, and acrylonitrile methacrylate copolymer films. Preferably the barrier film has a thickness in the range of about 0.5 to about 3 mils.

The heat-sealable film, when present, is a thermoplastic material that will soften and bond to a container finish with which it is in contact when heated at temperatures achieved during typical induction or conduction sealing operations, under the pressure exerted by the closure on the container seal between the closure and the container finish. Typically the pressure on the container seal is achieved by torquing a closure over the container seal onto a container finish with a torque in the range of about 15 inch-pounds to about 90 inch-pounds. Examples of materials that can be used as a heat-sealable film include low-density polyethylene, medium density polyethylene, polypropylene, ethylene vinyl acetate (EVA), ionomer films, and amorphous PET. Typically the heat-sealable film is selected to be of the same material as the container finish or of a material that is compatible with the container finish. Accordingly, a polyethylene film would be selected as a heat-sealable film to seal a high-density polyethylene container finish. Similarly, a PET film can be used as the heat-sealable film to seal a PET container finish. If it is desired that the sealant sheet be relatively easy to puncture by the consumer, a biaxially oriented thermoplastic material would be selected as the heat-sealable film. Preferably, the heat sealable film is medium density polyethylene, polypropylene, EVA copolymer, or PET. When a relatively strong, puncture-resistant sealant sheet is desired, a tough barrier film can be included over the heat-sealable film.

The selection of appropriate shape and dimensions for an container seal to be used with a particular closure and container combination is routine for one of ordinary skill in the packaging art. Typically, the dimensions of the container seal are chosen to be substantially equal to the inside dimensions of the upper surface of the closure, so that the upper surface of the container seal will fit snugly within closure. The thickness of the container seal is selected based on the clearance between the upper inside surface of the closure and the finish of a complementary container. Preferably, the thickness of the container seal is selected so that the container seal is slightly compressed when the material is sealed between the closure and a container finish. Such compression aids in forming a fluid and/or air-tight seal. Container closures are selected to match container finishes of complementary dimensions and design, as is well known in the packaging art.

The container seals of the present invention can be manufactured using standard coating and lamination techniques that are well known in the art. For example, a substrate layer and a polymer film can be laminated to foil using one or more conventional adhesives to form a liner portion. The polymer film of the liner portion can then be laminated to the obverse surface of promotional token by a releasable adhesive. The resulting laminate can then be laminated to the tacking surface of a sealant sheet by another releasable adhesive Preferably, the container seal of the invention has an overall thickness in the range of about 8 to about 85 mils, more preferably about 20 to about 40 mils. It is preferred that the liner portion of the material, when present, have a thickness in the range of about 10 to about 40 mils. Preferably, the sealant sheet portion has a total thickness in the range of about 0.5 to about 3 mils, more preferably about 0.5 to about 2 mils.

The container seals of the present invention can be manufactured to full machine width in a master roll form, utilizing standard roll coating and laminating equipment that is well known in the coating and laminating arts. Typically, the master roll of sheet material is slit to a desired width and shipped to a closure manufacturer. The closure manufacturer, in turn, die-cuts the slit master roll to the desired size and shape for use in particular container closures. The die-cut container seals are then inserted or pressed into the closure and sealed to a filled container as described above.

Any common closure design suitable for use with a liner or tamper evident seal can be used in conjunction with the container seals of the present invention. Preferred closures include standard, continuous threaded (CT) closures, which are well known in the art. Such closures are described, for example J. L. Heid and Maynard A. Joslyn, Eds. *Fundamentals of Food Processing Operations Ingredients, Methods, and Packaging*, The AVI Publishing Company, Inc., Westport, Conn. (1967), pp. 649-655.

It is currently difficult to provide a useful promotional indicia, such as a coupon or proof-of-purchase indicator within a container closure. The container seals of the present invention provide an integrated tamper-evident seal and separable promotional token. The container seals of the invention afford a convenient solution to the problem of providing promotional materials for a product, service, contest, and the like, under a container closure. The promotional indicia visible on the surface of the promotional token can include words, symbols, logos, bar codes, holographic images, art work, or any other information desired by the packager, product manufacturer, or retailer. The present invention advantageously provides a freely removable promotional token for use by a consumer when a container closure is removed by a consumer. The promotional token can be manufactured by printing, in register, the promotional indicia onto a master roll or a slit roll of container seal material or by imprinting such indicia onto a component material prior to assembling the container seal. Sections of container seal for use in a closure can be cut from a master roll in register with the printed material on the roll, using equipment and methods that are well known in the art.

It is preferred that the promotional token include printed promotional indicia promoting a product, a service, a contest, or a game, a company, an organization a cause, and the like, on one or both of its surfaces or on a layer subjacent to a surface, so long as the indicia are visible at the surface. More preferably the promotional indicia are in the form of a redeemable coupon, a proof-of-purchase indicator, or a game token. The promotional indicia can be printed in single or multicolor inks, as desired. The promotional token can also include a holographic image, if desired. Holographic images are typically film laminates having a hologram imbedded within a polymeric film layer. The use of a holographic image can provide security against counterfeiting of the promotional token, which could be useful for promotions involving high value sweepstakes, for example.

Numerous variations and modifications of the embodiments described above may be effected without departing from the spirit and scope of the novel features of the invention. No limitations with respect to the specific embodiments illustrated herein are intended or should be inferred.

We claim:

1. A container seal having a releasable, integral promotional token, the container seal comprising:

(a) a sealant sheet having a tacking surface and a sealing surface and including a layer of aluminum foil;

(b) a promotional token having a tacking surface and an obverse surface, at least one surface of the promotional token including promotional indicia visible thereon, the tacking surface of the promotional token being bound to the tacking surface of the sealant sheet by a first layer of releasable adhesive, the promotional token being peelably removable from the sealant sheet when the sealant sheet is bound to the finish of a container; and (c) a liner including a layer of compressible material, the liner having a closure-contacting surface and a tacking surface, the tacking surface of the liner being bound to the obverse surface of the promotional token by a second layer of releasable adhesive, the liner being separable from the promotional token without separating the promotional token from the sealant sheet;

wherein the promotional token consists of a material selected from the group consisting of a layer of paper or synthetic fabric, a layer of paper or synthetic fabric laminated to a polymer film, and a layer of paper or synthetic fabric laminated to two polymer films, and optionally, the tacking surface of the promotional token or the tacking surface of the sealant sheet comprises a release coating.

2. The container seal of claim 1 wherein the sealing surface of the sealant sheet comprises a heat-sealable polymeric film.

3. The container seal of claim 1 wherein the first layer of releasable adhesive is a pressure sensitive adhesive.

4. The container seal of claim 1 wherein the first layer of releasable adhesive is an intermittent layer of adhesive.

5. The container seal of claim 1 wherein the second layer of releasable adhesive is an intermittent layer of adhesive.

6. The container seal of claim 1 wherein the second layer of releasable adhesive is a layer of wax.

7. The container seal of claim 1 wherein the promotional token comprises a layer of paper or a synthetic fabric.

8. The container seal of claim 1 wherein the promotional indicia are in the form of a redeemable coupon, a proof-of-purchase indicator, or a game token.

9. The container seal of claim 1 wherein the tacking surface of the promotional token or the tacking surface of the sealant sheet comprises a release coating.

10. The container seal of claim 1 wherein at least one of the tacking surface of the liner and the obverse surface of the promotional token is capable of absorbing a sufficient amount of liquid wax from the layer of wax to cause the liner to release from the promotional token when the layer of wax is melted.

11. The container seal of claim 10 wherein the tacking surface of the liner comprises a layer of material selected from the group consisting of a paper and a synthetic fabric.

12. The container seal of claim 1 wherein the compressible material included in the liner is a layer of cellulose pulp or a layer of polymeric foam.

* * * * *